US005649865A

United States Patent [19]

Harvey

[11] Patent Number: 5,649,865

[45] Date of Patent: Jul. 22, 1997

[54] SPORTS APPARATUS

[76] Inventor: Robert Edward Harvey, Lodge Farm, Stamford Road, Market Deeping, Peterborough PE6 9JD, Great Britain

[21] Appl. No.: 583,497

[22] Filed: Jan. 5, 1996

Related U.S. Application Data

[63] Continuation of Ser. No. 185,933, filed as PCT/GB92/01330, Jul. 20, 1992, published as WO93/01872, Feb. 4, 1993, abandoned.

[30] Foreign Application Priority Data

Jul. 20, 1991 [GB] United Kingdom ..... 9115719

[51] Int. Cl.[6] ..... A63G 31/02

[52] U.S. Cl. ..... 472/90; 472/91; 482/71

[58] Field of Search ..... 472/59, 60, 88, 472/89, 90, 91; 482/54, 71; 434/253

[56] References Cited

U.S. PATENT DOCUMENTS

| | | | |
|---|---|---|---|
| 1,100,725 | 6/1914 | Gibson | 472/59 |
| 3,047,291 | 7/1962 | Hall | 272/56.5 |
| 3,195,889 | 7/1965 | Hall | 272/56.5 |
| 4,066,256 | 1/1978 | Trumbull | 472/60 |
| 4,423,864 | 1/1984 | Wiik | 272/97 |
| 4,790,531 | 12/1988 | Matsui et al. | 272/565 |
| 5,009,412 | 4/1991 | Roodenburg et al. | 472/59 |

FOREIGN PATENT DOCUMENTS

| | | | |
|---|---|---|---|
| 903891 | 4/1986 | Belgium . | |
| 4135581 | 5/1992 | Japan | 472/90 |
| WO89/02771 | 4/1989 | WIPO . | |
| 8800457 | 6/1989 | WIPO . | |

*Primary Examiner*—Kien T. Nguyen
*Attorney, Agent, or Firm*—McCormick, Paulding & Huber

[57] ABSTRACT

Sports apparatus having a variably tilting platform providing a continuously sloping surface. The platform is mounted to permit tilting in a plurality of planes. An actuating mechanism for tilting the platform includes at least two actuators and a fixed pivot or at least three actuators. The actuators may comprise rams or a crank mechanism. The actuators operate simultaneously and sequentially to cause a progressive and circulatory movement of the highest point of the tilting platform around the periphery of the platform. The sloping surface of the platform can be used for such sports activities as skiing, skateboarding and even hang gliding.

23 Claims, 3 Drawing Sheets

SPORTS APPARATUS

This is a continuation of application Ser. No. 08/185,933 filed as PCT/GB92/01330, Jul. 20, 1992 published as WO93/01872, Feb. 4, 1993, now abandoned.

The present invention relates to sports apparatus. More specifically, but not exclusively, the invention relates to apparatus for providing an artificial slope for sports such as skiing, skateboarding, roller skating and other similar sports. The invention may be applicable to hang gliding.

It is known to provide artificial ski slopes so that people who do not live near a natural ski resort may learn to ski and practice their skills. These slopes may be located on a naturally sloping surface, or alternatively an artificial surface may be constructed.

Limitations of space often result in slopes which are short and unchallenging for experienced skiers. The ski slopes themselves are expensive to construct, and many consider them to be unsightly. In addition, the majority of artificial slopes of this kind are situated out of doors and so may only be used when there are favourable weather conditions.

Some attempts have been made to overcome these problems. U.S. Pat. No. 4,790,531 describes an indoor skiing facility comprising a vertical support tower and a helical ski ramp positioned around and supported by the tower. The helix provides a relatively long slope compared to the land base area of the facility.

Many of the other proposals for simulating skiing are of the tread-mill type, an endless conveyor belt providing the surface for skiing. For example, U.S. Pat. No. 3,047,291 and U.S. Pat. No. 4,423,864 disclose angularly adjustable conveyor belts wherein the belt moves continuously in one direction against the movement of the skier. The tendency of the skier to ski off the surface is balanced by the friction imparted by the opposing movement of the belt.

This type of apparatus, although having the advantage of being compact and portable has the disadvantage that it does not accurately reproduce the experience of downhill skiing because the skier has zero velocity relative to the ski surface.

U.S. Pat. No. 3,195,889 and WO89/02771 show a variation on this idea. The ski surface is an inclined rotating disc such that skiers may ski downhill against the movement of the skiing surface, with the speed of rotation chosen to provide the desired relative motion between the skier and the surface.

However, these prior proposals do not provide a continuous downhill skiing surface. Skiers only have a limited downhill run from the top of the incline to its lowest point. The length of the run is thus determined by the size of the disc.

One way of overcoming this problem is disclosed in BE 903891. This specification describes a ski-training see-saw. A mobile floor can swing up and down like a see-saw. This allows the skier to ski continuously to and fro. As shown in sheets one and two of the drawings the floor rocks back and forth in see-saw fashion, resting alternately on two mutually inclined base surfaces (referred-to as providing support at one or more points), or the floor pivots on a pin (not shown) in a manner more directly analogous to that of a see-saw. In either case, the skier starts off down the surface as shown in "phase I" and reaches the bottom as shown in "phase II" and turns round, before the see-saw tips over for him to perform the reverse traverse, as shown in "phase III". This sequence is repeated in phases IV and V. Phase VI is a repetition of phase I. It is stated the skier can ski continuously or permanently to and fro, doing turns, circles, slalom etc.

In the embodiment of sheet 4 of the drawings of BE 903891 there is shown a modification in which, in addition to the pivot effectively provided between the two base surfaces of the tippable see-saw, there is provided an additional pivot, spaced upwardly therefrom, as shown in the third, fourth and fifth figures on sheet 4. This is referred to in the description as "a see-saw in one or more directions". It will be understood that, nevertheless, this see-saw action is still strictly limited to movement in a single plane.

The Belgian specification explains the principle of the invention as corresponding to that of a marble which rolls up and down or from left to right in a rocking tray, as would indeed be produced by a see-saw action, depending on the alignment of the see-saw pivot. The specification also mentions, in additional explanation of the principle of the invention, that the marble may remain "rolling around or diametrically in a round plate through the plate being moved for this purpose". Such "rolling around" or "diametrical" movement will be produced by the marble directly as a result of the see-saw movement, depending on whether the marble is initially located at the highest point of the plate (diametrical movement), or half way down (rolling around movement caused by the curved periphery of the plate).

I have identified a need for improvements with respect of the matter disclosed in the above-discussed Belgian specification. It is perfectly possible for a skier on the surface of the Belgian apparatus to ski diametrically, or circumferentially, in the manner of the explanatory marble. Indeed, a skier commencing at the highest point can choose in any case to ski in the circumferential direction. However, the strictly see-saw action of this prior proposal means that each skier must simply ski to the bottom of the floor, turn round and then wait for it to tip back the other way. By judicious timing, it is of course possible to enjoy continuous skiing in this way, but the operation of the apparatus is inherently intermittent and back and forth.

I have identified a need for sports apparatus providing a more continuously sloping surface.

PCT/AU88/00457 describes apparatus for generating a surface wave on a sports platform. The apparatus comprises a flexible deck constructed with a lateral deformation which provides a permanent wave formation in the deck. The apparatus also includes means located within the lateral deformation which are capable of moving along the ground, thus moving the wave formation relative to the flexible deck.

DE 2713382A describes a sports training devise comprising a centrally pivoted disc and a rotatable base component. Rotation of the base component causes the disc to execute a wave-type motion.

Neither of the above specifications disclose a sports platform which offers a variation in the mode of movement of the platform.

Accordingly, an object of the present invention is to provide sports apparatus offering, in use, a continuously sloping surface, and/or such apparatus in which the highest point on a platform circulates continuously around the periphery of the platform, and/or one or more other improvements in matters discussed or disclosed herein.

According to the invention there is provided sports apparatus as defined in the accompanying claims.

In a preferred embodiment there is provided a platform, mounting means for the platform which permits it to tilt in various planes, and actuating means to tilt the platform to effect a sequence of up and down movements. These first features correspond to the features disclosed in the prior Belgian specification, whereby it is perfectly possible to obtain a continuous and circulatory skiing action on a generally downhill surface, provided the skier times his movements in sequence with the switch-over of the see-saw action apparatus.

However, in the preferred embodiment of the present invention there is provided at least one further actuator connected to the platform at a location spaced from the first actuator so as to introduce an additional component of movement. This additional component of movement produces a three-dimensional effect. Whereas the see-saw action is entirely in one plane, the additional actuator causes an undulating effect by virtue of a relatively complex interaction with the movements of the first actuator.

Sequencing means is provided to time the interactions of the two actuators. In addition, the mounting means for the platform permits the necessary three dimensional movement. In the case where only two actuators and a pivot are used, the pivot provides for pivotal movement in more than one plane.

The sequencing means is arranged to cause the complex interaction of the two sets of movement produced by the actuators so as to cause a progressive and circulatory movement of the highest point of the titling platform, around the periphery of the platform. In this way, as a skier (or skateboarder etc) moves round the platform, so he finds that he is always in a zone in which the part of the disc infront of him is falling and the part of the disc behind him is rising, and thus he also is always on a downhill slope while being maintained at approximately the same level at all times.

The invention envisages that for certain applications the amplitudes of movement of the actuators may vary in order that the movement of the platform varies with time so that, for example, at certain times a skier finds himself on a more steeply sloping surface, or else that the circulatory movement of the platform speeds up at certain times during each rotation.

While some sports are inherently downhill sports, there are others where an uphill surface is an advantage, and this applies to cross-country running, mountain biking, circuit training etc. It is envisaged that the apparatus may well be used for such purposes, and indeed generally for fitness training.

As regards actuating means, the preferred embodiments employ cranks as the actuators for simplicity. Perhaps the simplest form of the invention comprises a single crankshaft with two cranks disposed about 90 degrees out of phase, and connected to the platform at intervals subtending an angle of about 90 degrees at the centre. Angles within a tolerance range of plus or minus 10 degrees of these values are contemplated. The central pivot is, effectively, a ball joint or merely a lose pivot permitting multi-plane movement. The connected cranks automatically remain in correct relative phase difference to each other so that the cranks impart a controlled sequence of movements to the platform. Where rams are employed as actuators, these need a control system to operate them in proper phased relationship. Multiple cranks could be interconnected by chain drives so as to remain in proper phase relationship to each other.

Embodiments of the invention will now be described by way of example with reference to the accompanying drawings in which.

Figure 1:
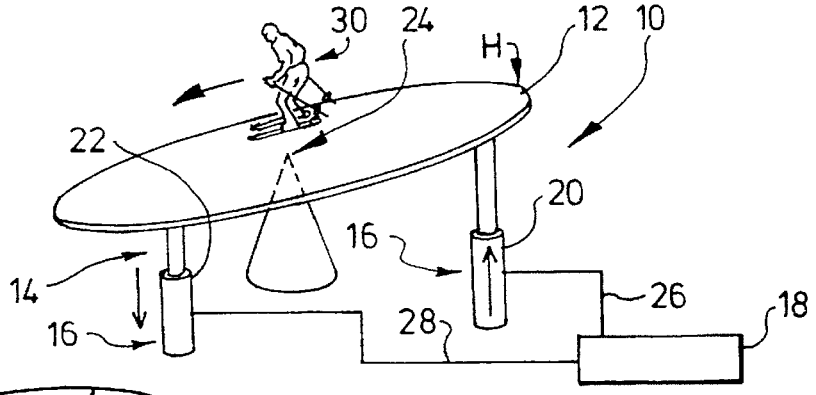
FIGS. 1 to 5 show a first embodiment of the invention, and illustrate a sequence of events as a skier progresses around the apparatus.
Figure 2:
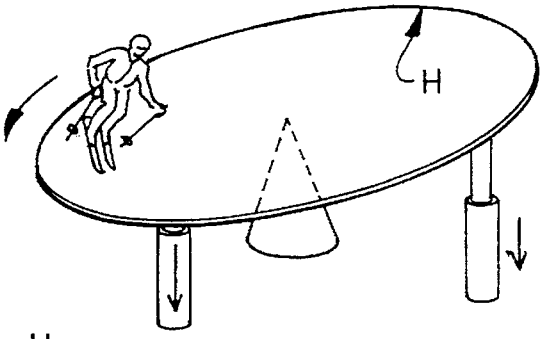
Figure 3:
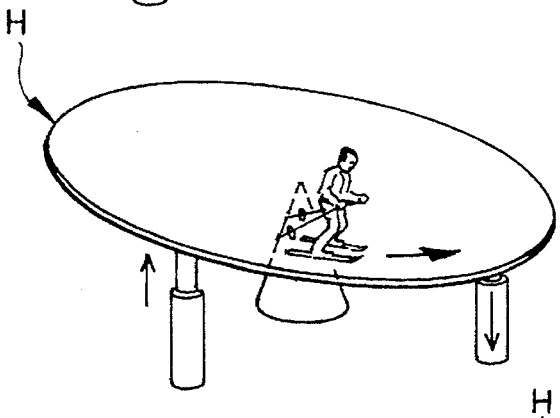
Figure 4:
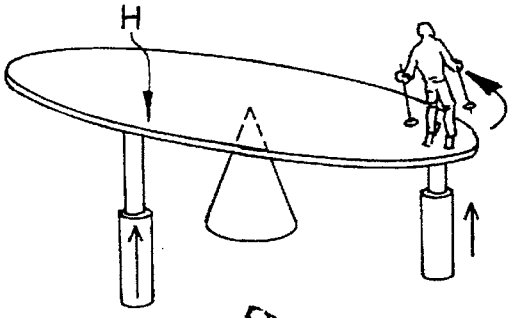
Figure 5:
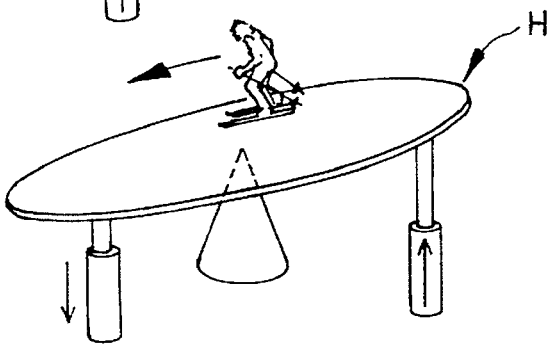

As shown in FIGS. 1 to 5, sports apparatus 10 comprises a platform 12, mounting means 14 and actuating means 16 together with sequencing means 18 connected to the actuator means. The sequencing 18 means is shown only in FIG. 1, for reasons of illustrative simplicity.

Platform 12 is generally disc shaped and provided with any suitable surface appropriate to the sporting activity to be performed thereon. The platform 12 shown in FIGS. 1 to 5 is drawn in unduly small dimensions, merely for purposes of simplicity of illustration.

Mounting means 14, in this embodiment, is constituted by a pair of ram mechanism or hydraulic rams 20, 22, and a central pivot 24. As will be explained below, the rams also constitute actuating means 16.

The connection of the rams, 20, 22 and pivot 24 to platform 12 is, in each case, by a joint (not shown) which permits rocking pivotal movement in multiple planes.

Actuating means 16, thus comprises rams 20 and 22. It can be considered that pivot 24 constitutes part of the actuating means, in the sense of a fixed point. The connection between the platform and the pivot resists upward movement of the platform when the rams extend.

Rams 20 and 22 may be electric or hydraulic or pneumatic. Sequencing means 18 is connected by power supply lines 26, 28 to the rams to effect sequenced operation thereof, as discussed above.

The sequence of operations is illustrated in FIGS. 1 to 5. In each figure the location of the highest region is indicated by arrow H. It can be seen that location H moves progressively round the platform 12 as the sequence of ram operations illustrated in FIGS. 1 to 5 progresses.

The skier 30 skis round the platform accordingly, and maintains his position at a convenient or chosen distance from the location H. In this way, he progressively skis round the platform on a downhill surface at all times, with a smooth and progressive action, and without any need to turn round in the sense that was required in the apparatus of the prior Belgian specification discussed above. The downhill sloping action of the platform positively carries round the skier at the correct speed.

Figure 6:
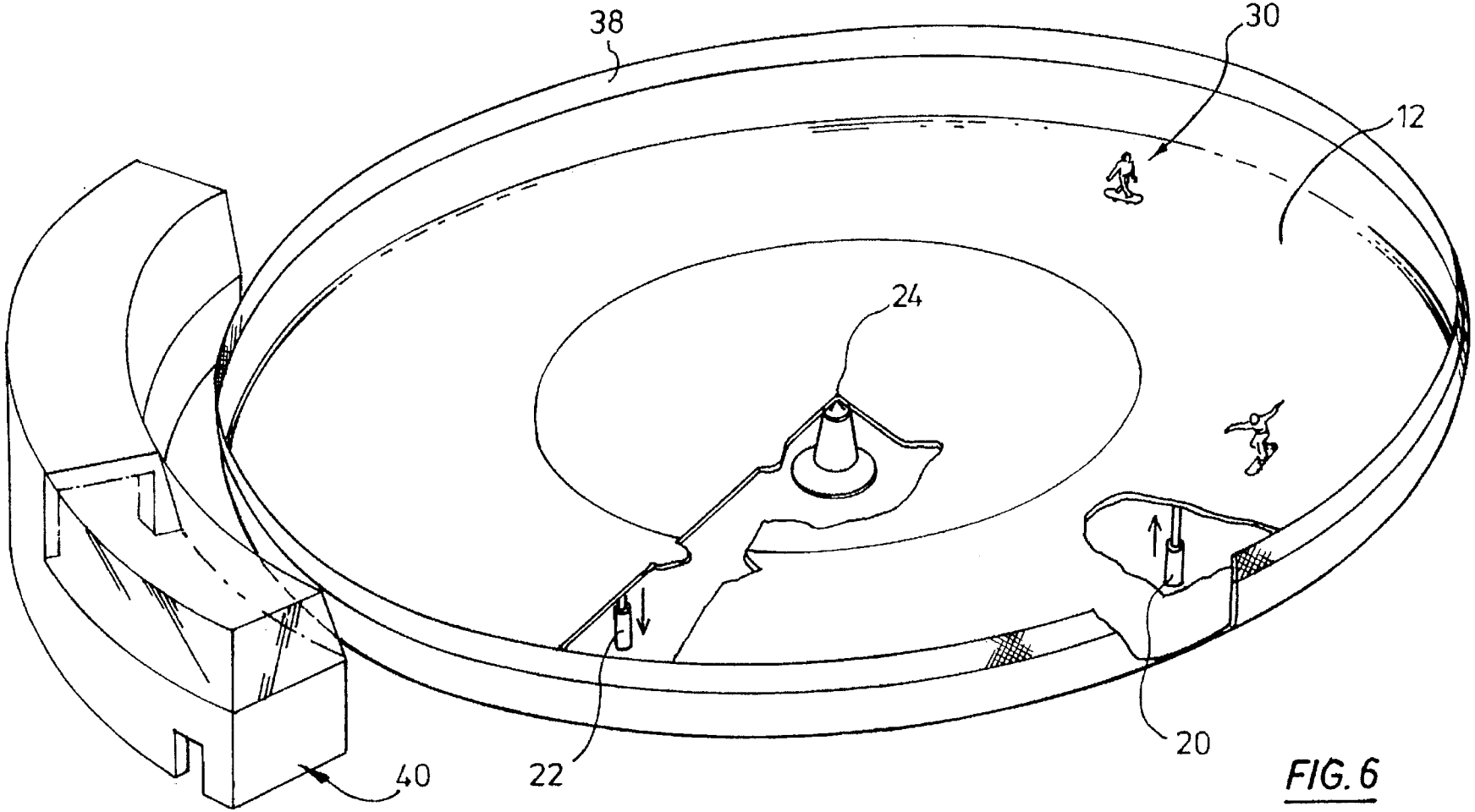
FIG. 6 shows a perspective view of a second embodiment.

In the embodiment of FIG. 6, the apparatus is generally as described above in relation to FIGS. 1 to 5, and the corresponding parts are therefore given the same reference numerals as in FIGS. 1 to 5.

Platform 12 is shown with a peripheral raised flange or wall 38 to serve as a convenient guide or enclosure for users. In this embodiment these are shown as skateboards, and the surface of the platform is constructed accordingly.

Along-side platform 12 is a building 40 for the benefit of users. The entire apparatus of FIG. 6 may be enclosed within a weatherproof stadium.

Figure 7:
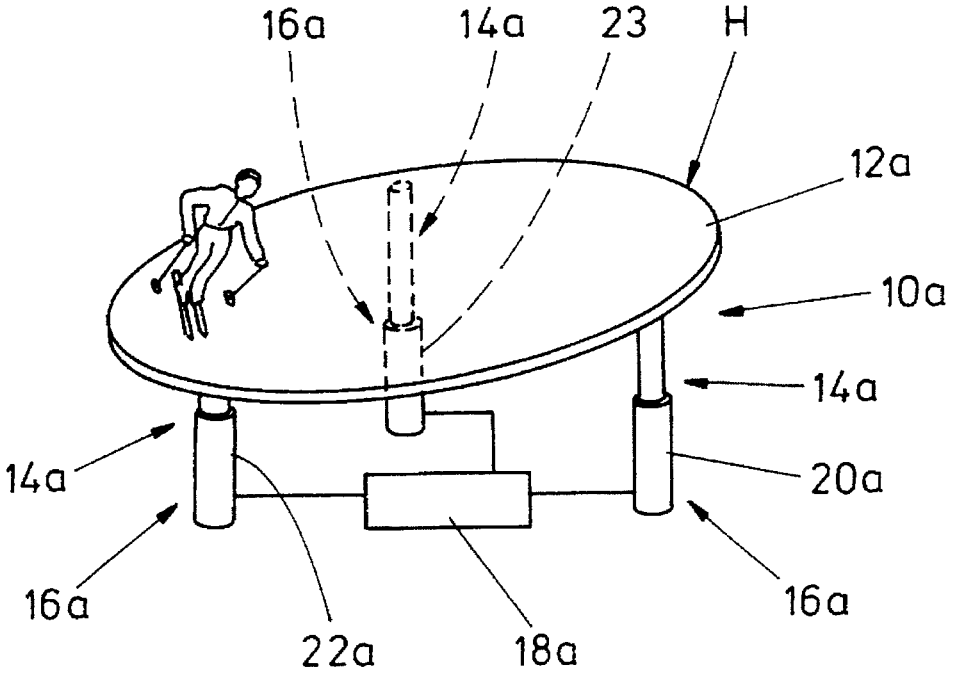
FIG. 7 is a perspective view of another embodiment of the invention.

In FIG. 7 there is shown a further embodiment of the invention indicated generally at **10*a* which includes a circular platform 12*a*. The platform 12*a* is supported by three actuators or rams 20*a*, 22*a* and 23 which comprise an actuating means 16*a* for titling the platform. The rams also comprise the mounting means for supporting the platform 12*a*. The sports apparatus 10*a* also includes a sequencing means 18*a* to effect sequenced operation of the three rams to cause a progressive and circulatory movement of the highest point H of the tilting platform 12*a*** around the periphery of the platform.

Figure 8:
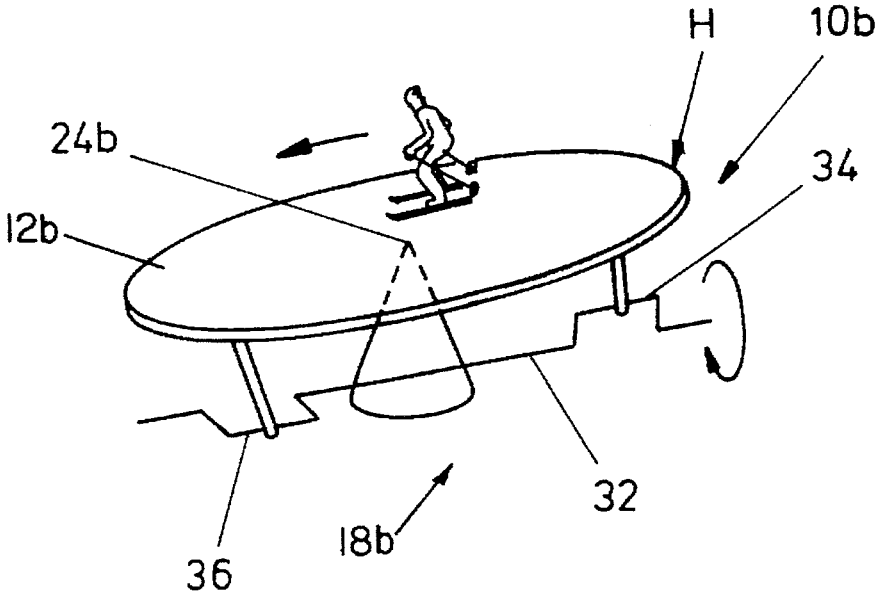
FIG. 8 is a perspective view of a further embodiment of the invention.

In FIG. 8 there is shown a further preferred embodiment of the invention indicated at **10*b*. The sports apparatus 10*b* includes a circular platform 12*b* supported at is centre by a fixed pivot point 24***b*. An actuating means 18*b* for tilting the platform 12*b* comprises a crankshaft 32 which includes cranks 34 and 36. The cranks 34 and 36 are offset from each other 90 degrees about the axis of rotation of the rotary crankshaft 32. The cranks 34 and 36 are connected to the platform to actuate the platform in substantially the same manner that the aforedescribed platform 12 is actuated by the rams 20 and 22. The crankshaft 32 is rotated by a drive mechanism (not shown) so that the cranks 34 and 36 operate simultaneous and sequentially to tilt the platform 12*a* to maintain a sloping surface.

Amongst other modifications which could be made in the above embodiments, while remaining within the scope of the invention, are the following:

1 The use of actuating means disposed at relatively short intervals all round the periphery of the platform, and operated in sequence;

2 Variation of the phase difference between successive actuating means to vary the mode of movement of the platform;

3 Variation in the amplitude of movement of the actuating means;

4 Variation in the shape of the platform, and its surface, according to the varying requirements of differing sports and activities;

5 The use of the platform for hang gliding purposes, whereby the user would take advantage of the sloping surface for launch purposes, while optionally being tethered to a central mast or support. After take-off the user would perform a rotary motion and lift would be provided by the air current generated by the movement of the platform acting, to some extent, in the manner of a fan directed upwards;

6 Control of the sequencing means to produce different paths around the platform for the highest point thereon eg a figure-of-eight path on an oval platform; and 7 Alternative actuation means including magnetic devices, bellows devices or any other thrust device; and 8 Other shapes of path besides circular, and figure-of-eight indeed any continuous path shape is possible.

I claim:

1. Sports apparatus comprising:

a) a platform defining a generally upwardly facing surface for the performance of sports activities thereon;

b) mounting and actuating means for supporting and tilting said platform and comprising means defining a stationary pivot and plurality of spaced apart actuators including a first actuator connected to and acting upon said platform at a first location for effecting a sequence of up and down movements of said platform and a second actuator connected to and acting upon said platform at a second location spaced from said first location in a peripheral direction of said platform for effecting another sequence of up and down movements of said platform; and c) sequencing means for operating said actuators simultaneously each in its own continuing sequence of operations overlapping with those of the other of the actuators to cause a progressive and circulatory movement of the highest point of the tilting platform around the periphery of said platform, whereby the slope of said surface defined by said platform enables the performance of downhill sports activities thereon.

2. Sports apparatus according to claim 1 characterized by said mounting and actuating means comprising means for supporting said platform to tilt in an infinite number of planes.

3. Sports apparatus according to claim 1 characterized by said actuating means comprising three actuators disposed at spaced locations around said platform.

4. Sports apparatus as set forth in claim 1 wherein each of said actuators comprises a ram mechanism including an extendible and retractable ram.

5. Sports apparatus according to claim 4 characterized by said sequencing means comprising a control system for extending and retracting said rams at a required phase difference to produce said circulatory movement of said highest point.

6. Sports apparatus as set forth in claim 1 wherein said mounting and actuating means comprises said sequencing means.

7. Sports apparatus as set forth in claim 6 wherein said mounting and actuating means comprises a rotary crankshaft having an axis of rotation and a first crank defining said first actuator and a second crank defining said second actuator.

8. Sports apparatus as set forth in claim 7 wherein said second crank is an angular offset from said first crank about said axis of rotation of said crank shaft.

9. Sports apparatus, as set forth in claim 7, wherein said cranks are angularly spaced from each other about said axis of rotation and connected to said platform at locations angularly spaced from each other about the axis of said circular path and the angular spacing between said locations of the connections about said axis of said circular path is substantially equal to the angular spacing between said cranks about said axis of rotation.

10. Sports apparatus, as set forth in claim 9, wherein said angular spacing comprises 90 degrees.

11. Sports apparatus as set forth in claim 1 wherein said platform is generally circular.

12. Sports apparatus as set forth in claim 11 wherein said mounting means comprises means defining a fixed pivot point supporting said platform at its center.

13. Sports apparatus as set forth in claim 11 including a raised flange about the periphery of said circular platform.

14. A method of operating sports apparatus comprising:

(a) a platform defining a generally upwardly facing surface for the performance of downhill sports activities thereon;

(b) mounting means for supporting and tilting said platform and comprising a plurality of spaced apart actuators including a first actuator connected to and acting upon said platform at a first location, and a second actuator connected to and acting upon said platform at a second location spaced from said first location in a peripheral direction of said platform; and c) sequencing means for operating said actuators simultaneously each in its own continuing sequence of operations overlapping with the operations of the other of the actuators;

d) causing said first and second actuators to effect first and second sequences of up and down movements of said platform at said first and second locations; and e) causing said sequencing means to operate said actuators simultaneously each in its own continuing sequence of operations overlapping with the operations of the other of the actuators so as to maintain said platform in a tilted condition and so as to continuously and progressively move the highest point of the tilted platform in a circular path around the periphery of said platform, whereby the slope of said surface defined by said platform enables the performance of said downhill sports activities thereon.

15. The method of claim 14 including the additional step of varying the amplitude of movement of said spaced-apart actuators to vary the degree of said slope of said surface.

16. The method of claim 14 further characterized in that said step of causing said first and second actuators to effect said sequences of up and down movements is performed so as to vary the speed of movement of said highest point of said tilted platform in said circular path.

17. The method of claim 14 wherein said plurality of spaced apart actuators comprises three such actuators connected to said platform at spaced locations thereon and said step on causing said sequencing means to operate said actuators comprises causing said three actuators to operate simultaneously and in overlapping operational relationship to each other to maintain said platform in said tilted condition.

18. A method of operating sports apparatus comprising:

(a) a platform defining a generally upwardly facing surface for the performance of uphill and downhill sports activities thereon:

(b) mounting means for supporting and tilting said platform and comprising a plurality of spaced apart actuators including a first actuator connected to and acting upon said platform at a first location, and a second actuator connected to and acting upon said platform at a second location spaced from said first location in a peripheral direction of said platform; and (c) sequencing means for operating said actuators simultaneously each in its own continuing sequence of operations overlapping with the operations of the other or others of the actuators;

(d) causing said first and second actuators to effect first and second sequences of up and down movements of said platform at said first and second locations; and (e) causing said sequencing means to operate said actuators simultaneously and in overlapping operational relationship to each other, each of said actuators operating in its own continuing sequence of operations to maintain said platform in a tilted condition and so as to continuously and progressively move the highest point of the tilted platform in a circulatory path on the surface of said platform, whereby the slope of said surface defined by said platform enables the performance of said uphill and downhill sports activities thereon.

19. The method of claim 18 including the additional step of varying the amplitude of movement of said spaced-apart actuators to vary the degree slope of said surface for the performance of sports activities.

20. The method of claim 18 wherein said step of causing said first and second actuators to effect said sequences of up and down movements is performed so as to vary the speed of said circulatory movement of said highest point of said platform.

21. The method of claim 18 wherein said step of causing said sequencing means to operate said actuators is performed so as to cause said high point of the tilted platform to execute a figure eight path on said platform.

22. The method of claim 18 wherein said plurality of spaced apart actuators comprises three such actuators connected to said platform at space locations thereon and said step on causing said sequencing means to operate said actuators comprises causing said three actuators to operate simultaneously and in overlapping operational relationship to each other to maintain said platform in said tilted condition.

23. A method of operating sports apparatus comprising:

(a) a platform defining a generally upwardly facing surface for the performance of uphill and downhill sports activities thereon;

(b) mounting means for supporting and tilting said platform and comprising a plurality of spaced-apart actuators connected to and acting upon said platform at locations spaced-apart in a peripheral direction of said platform; and (c) sequencing means for operating said actuators simultaneously each in its own continuing sequence of operations overlapping with the operations of other of said actuators:

(d) causing said first and second actuators to effect first and second sequences of up and down movements of said platform at said locations; and (e) causing said sequencing means to simultaneously operate said actuators in overlapping relation to each other so as to maintain said platform in a tilted condition and so as to continuously and progressively move the highest point of the tilted platform in a circulatory path, whereby the slope of said surface defined by said platform enables the performance of said uphill and downhill sports activities thereon.

* * * * *